United States Patent [19]

Piske

[11] 4,276,677

[45] Jul. 7, 1981

[54] TRAVELING COVER

[75] Inventor: Wolfgang Piske, Monchen-Gladbach, Fed. Rep. of Germany

[73] Assignee: Trutzschler GmbH & Co. KG., Monchen-Gladbach, Fed. Rep. of Germany

[21] Appl. No.: 942,147

[22] Filed: Sep. 14, 1978

[30] Foreign Application Priority Data

Sep. 17, 1977 [DE] Fed. Rep. of Germany ..... 2742015

[51] Int. Cl.[3] ..... D01G 15/08

[52] U.S. Cl. ..... 19/102; 19/111

[58] Field of Search ..... 19/102–104, 19/109–111

[56] References Cited

U.S. PATENT DOCUMENTS

| | | | |
|---|---|---|---|
| 335,760 | 2/1886 | Leigh | 19/102 |
| 335,761 | 2/1886 | Leigh | 19/102 |
| 1,363,094 | 12/1920 | Draper | 19/111 |
| 4,126,915 | 11/1978 | Zeig et al. | 19/111 |

*Primary Examiner*—Louis Rimrodt

*Attorney, Agent, or Firm*—Haseltine and Lake

[57] ABSTRACT

A revolving flats arrangement for carding operation, and which is provided with a drive, guide and deflection element. Flats on both ends slide on guides, and are constructed so as to avoid the use of a flats chain. A driving element pushes ahead the flats in the region of a deflecting roller. Of the two deflecting rollers that are provided, one is used as a driving element. The driving element has engaging members 8, shaped as sprocket portions, and the flats can be pressed against the sliding guide by a belt or an elastic element. The flats are directed along a predetermined path by the sliding guide, and they form on the side facing the card cylinder, at one location, a gap which is associated with a vacuuming device. The clothing of the flats is located on the side facing from the card clothing, and is cleaned by an axially movable cleaning device.

3 Claims, 2 Drawing Figures

TRAVELING COVER

BACKGROUND OF THE INVENTION

The present invention relates to a revolving flat arrangement for carding equipment with drive, guidance and deflection elements, and in which flats on both ends slide on sliding guides.

With a revolving flat arrangement known in the art, the flats with the card clothing are held and guided on sliding guides, the so-called flexible arcs between lateral card cylinder. These card cylinder are assembled from bushings with successive inner and outer fishplates where the fastening parts of the flats are inserted in the holes of the bushings. The adjustment of the drum and card clothing with their tips relative to each other, must proceed with high accuracy. This accuracy and working life depend mainly on the flats chains. A play between the chain links and a lengthening of the chains over a period of time have a very disadvantageous effect. The chain links must be lubricated at certain time intervals to maintain flexibility. Finally tensioning elements are necessary in order to keep the portion of the chains facing the card cylinder under tension. With this revolving flat arrangement, installation time is very high since first the ends of the rods must be fastened in the bushings of the chains, and then they must be installed with great precision on the sliding guides. Another great disadvantage is that a gap of 1 to 3 mm exists between adjacent flats; through this gap, large amounts of dust, short fibers, etc. can pass to the outside. This revolving flat arrangement has considerable disadvantages from a construction and functional viewpoint.

Accordingly, it is an object of the present invention to provide a revolving flats arrangement of the aforementioned type which avoids the disadvantages mentioned, where the problems caused by the flats chains do not arise and which has a much shorter installation time, and where the amount of dust carried outside is reduced.

Another object of the present invention is to provide a revolving flats arrangement of the foregoing character which is substantially simple in constructions and may be economically fabricated.

A further object of the present invention is to provide an arrangement, as described, which may be readily maintained in service and which has a substantially long operating life.

SUMMARY OF THE INVENTION

The present invention is based on the concept of not pulling the flats via cover chains, but to push them forward by a driving element. Then the separate production of flats chains becomes superfluous. All disadvantages caused by the flats chains, for example, the stretching, the application and maintenance of tension and lubrication, disappear. The construction of the flats can be simplified because the fastening elements on the side for connecting to the flats chains and the threaded holes in the flats are no longer required. The installation time is reduced considerably by simply placing the flats one after the other on the sliding guides. The speed of the flats can be determined by the driving element and adapted to operating conditions. A special advantage is that the flats are immediately adjacent to each other and leave no gaps between them, providing a virtually jointless revolving flats arrangement. This completely prevents the passage of dust.

It is expedient to use one of the two deflecting rollers as driving element for the flats. The driving element is equipped with engaging members, for example, in the form of a gear, with the flats being advanced by the tooth flanks. In order to keep the distance between the card clothing and the flats clothing constant, it is necessary that the revolving flats are in contact on both sides with the sliding guides. This can be accomplished, for example, by pressing a solid flexible belt against the rear sides of the ends of the flats. Self-adherent spring elements can also be used. As a result, the flats can make an evasive movement against the belt tension or spring force in case of sudden resistance. An advantageous construction has the flats arranged in form-locked sliding guides. For easier sliding, the ends of the flats may slide on ball bearings in the sliding guides. A preferred embodiment provides that the flats leave a gap through which the dust may be vacuumed at a few locations, preferably one spot, on the side facing the card clothing. This gap may be formed by an element, for example, with a stop. Another advantageous embodiment provides that the clothing of the flats located on the side facing away from the card clothing is cleaned by an axially movable cleaning device during the return stroke. The cleaning device travels over the flats clothing and possibly returns. According to another preferred embodiment, the flats are arranged between the deflecting rollers only on the side facing the clothing, with a restoring (return) device being provided for returning the flats which have passed the side facing the driving element. With this embodiment, in contrast to the revolving flats arrangement known in the art, about half the flats can be saved.

The novel features which are considered as characteristic for the invention are set forth in particular in the appended claims. The invention itself, however, both as to its construction, its method of operation, together with additional objects and advantages thereof, will be best understood from the following description of specific embodiments when read in connection with the accompanying drawings.

DESCRIPTION OF THE PREFERRED EMBODIMENTS

Figure 1:
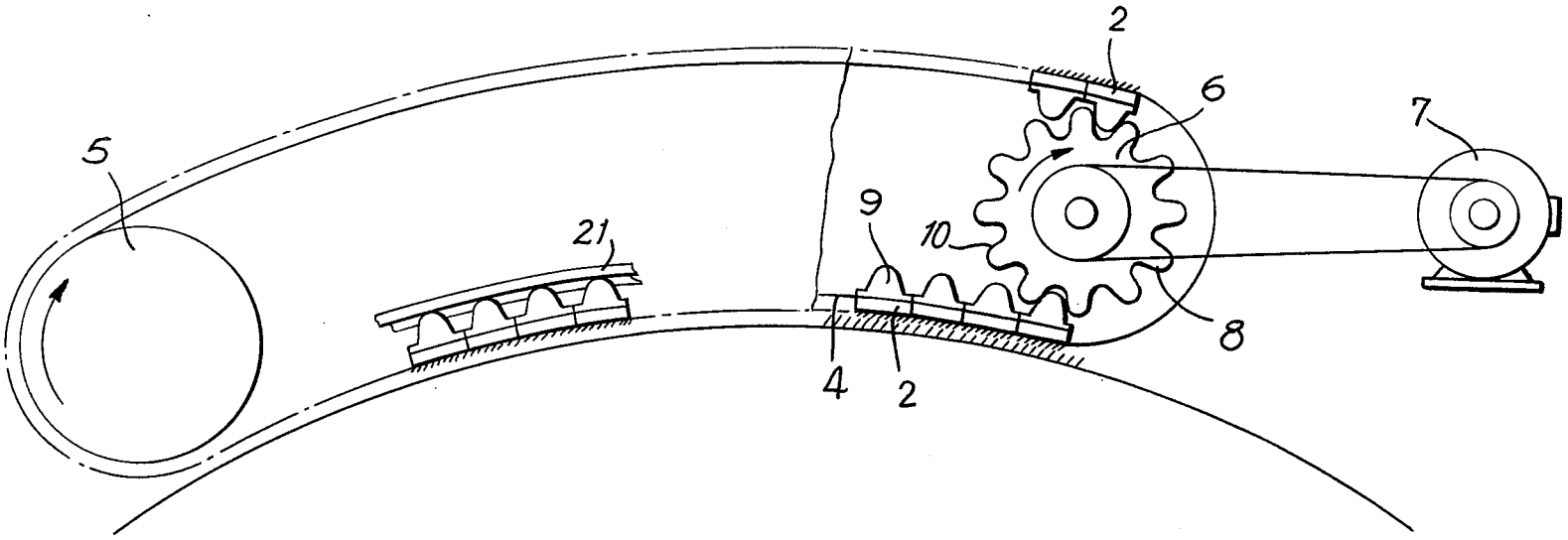
FIG. 1 shows a side view of a revolving flats arrangement in accordance with the present invention.

FIG. 1 shows a revolving flats arrangement which is located above a drum 1 of a carding machine and includes flats 2 of which the illustrative only shows a few. These flats are arranged directly one after the other without joints and their ends are in contact with upper and lower sliding guides, 3, 4. The revolving flats arrangement also includes two deflecting rollers, 5, 6 around which the flats revolve so that a continuously revolving flats clothing is formed. One deflecting roller 6 is connected to a drive motor 7 and has tooth-shaped engaging members 8 on its periphery. On their rear side the cover rods 2 with their stubs 9, engage the gaps between the engaging members 8. By rotating the deflecting rollers clockwise, the stubs 9 of flats 2 are moved ahead by the flanks 10 of the engaging members 8 in the operating/working direction. In this manner, the flats 2 are moved ahead by the driving element 15 located in the region of the deflecting roller 6. The flats are held in contact with the sliding guides by a belt or other elastic element 21.

Figure 2:
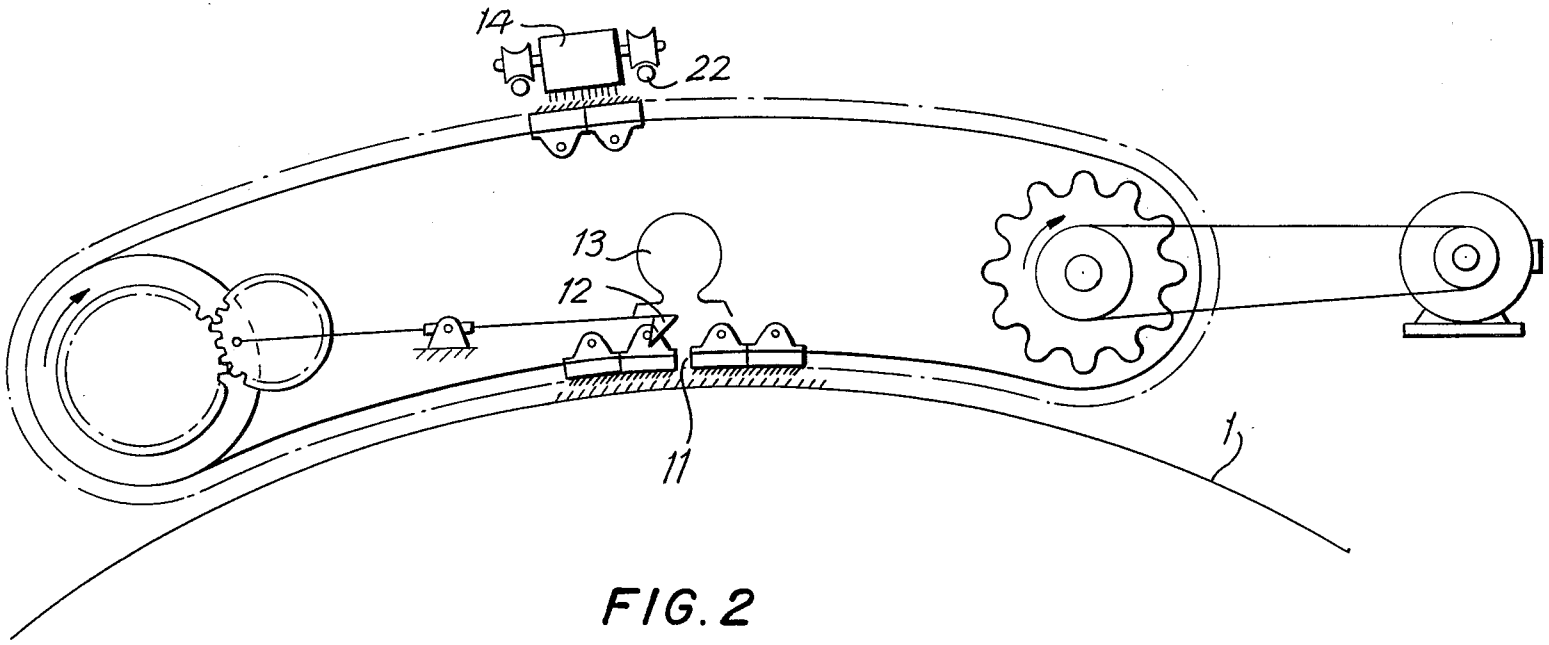
FIG. 2 shows another embodiment of the invention.

FIG. 2 shows an embodiment where the flats 2 form a gap 11 at one location on the side facing the card cylinder 1 clothing. For this purpose, a spring-loaded restoring element 12 with stop is provided. Above gap 11 is a vacuuming device 13 for removing dust etc. During the return travel, the flats 2 fastened to the side facing away from the card cylinder 1 clothing are cleaned by a cleaning machine 14 which travels back and forth over the clothing of the flats 2 in the lengthwise direction along rails 22.

Without further analysis, the foregoing will so fully reveal the gist of the present invention that other can, by applying current knowledge, readily adapt it for various applications without omitting features that, from the standpoint of the prior art, fairly constitutes essential characteristics of the generic or specific aspects of this invention, and therefore, such adaptations should and are intended to be comprehended within the meaning and range of equivalents of the following claims.

What is claimed is:

1. A revolving flats arrangement for carding equipment, comprising: guide means with two sides; flats sliding with both ends on said guide means; deflecting roller means having a driving element, said driving element having members for engaging said flats, said flats being pressable against said guide means by an elastic element, said guide means restricting said flats to a predetermined path, said flats being substantially held in predetermined position by said guide means, said flats forming a gap on one side and at one location; vacuuming means for communicating with said gap inside said revolving flats arrangement and between said deflecting rollers; said flats having clothing located on a side facing away from clothing on a card cylinder; axially movable cleansing means for cleaning the clothing of said flats; said deflecting roller means comprising two deflecting rollers, said flats being arranged between said deflecting rollers only on one side facing said card cylinder; return means for returning said flats; one of said deflecting rollers comprising driving means and having a sprocket-shaped portion, said flats having a peripheral surface shape to conform to said sprocket-shaped portion when said flats are located adjacent to each other, said sprocket-shaped portion engaging corresponding surface portions of said flats for moving said flats slidingly along said guide means toward the other deflecting roller.

2. A revolving flats arrangement as recited in claim 1, in which said flats further comprises outward projecting bulging portions engaging sprocket tooth gaps in said deflecting rollers, said outward bulging portions extending only along a portion of the flats neighboring projecting bulging portions forming gaps for admitting sprocket teeth of said deflecting rollers.

3. A revolving flats arrangement for carding equipment, comprising:

(a) a guide means;

(b) a plurality of flats slidingly pushed on said guide means, said flats being pressable against the guide means by an elastic element and the flats being substantially held in predetermined position by the guide means the improvement comprising, said flats being slidingly pushed with both ends on said guide means free of flexible connection means, said flats being disconnected from each other;

(c) a deflecting roller means having driving means and a sprocket-shaped portion engaging corresponding surface portions to said flats for moving them slidingly along the guide means toward one of the deflecting roller means, said driving means engaging said surface portions of said flats so that said flats are moved along said guide means by abutting against each other;

(d) a vacuuming means for communicating with a gap inside the revolving flats arrangement and between the deflecting roller means; and (e) a return means for returning said flats to a predetermined position.

* * * * *